US008111124B2

(12) United States Patent
Hagiya

(10) Patent No.: US 8,111,124 B2
(45) Date of Patent: Feb. 7, 2012

(54) INDUCTANCE ELEMENT AND METHOD FOR MANUFACTURING THE SAME

(75) Inventor: Akio Hagiya, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/752,746

(22) Filed: Apr. 1, 2010

(65) Prior Publication Data

US 2010/0201471 A1 Aug. 12, 2010

Related U.S. Application Data

(63) Continuation of application No. PCT/JP2008/067793, filed on Oct. 1, 2008.

(30) Foreign Application Priority Data

Oct. 2, 2007 (JP) ..... 2007-258317

(51) Int. Cl.
*H01F 27/02* (2006.01)
*H01F 27/29* (2006.01)
*H01F 7/06* (2006.01)

(52) U.S. Cl. ..... 336/83; 336/90; 336/92; 336/96; 336/98; 336/192; 29/602.1

(58) Field of Classification Search ..... 336/83, 336/90, 92, 96, 98, 192; 29/602.1
See application file for complete search history.

(56) References Cited

U.S. PATENT DOCUMENTS

| | | | | |
|---|---|---|---|---|
| 6,033,594 | A * | 3/2000 | Enokido et al. | 252/62.62 |
| 6,545,415 | B1 * | 4/2003 | Ward | 315/56 |
| 2007/0188281 | A1 * | 8/2007 | Iguchi et al. | 335/299 |

FOREIGN PATENT DOCUMENTS

| | | | |
|---|---|---|---|
| JP | 6-251946 | | 9/1994 |
| JP | 7-272919 | | 10/1995 |
| JP | 10247603 | A * | 9/1998 |
| JP | 2002-141216 | A | 5/2002 |
| JP | 2006202880 | A * | 8/2006 |
| JP | 2007-207928 | A | 8/2007 |

OTHER PUBLICATIONS

International Search Report; PCT/JP2008/067793; Jan. 13, 2009.
K. Uda; "Written Opinion of the International Searching Authority"; PCT/JP2008/067793; Jan. 13, 2009.

* cited by examiner

*Primary Examiner* — Elvin G Enad
*Assistant Examiner* — Tsz Chan
(74) *Attorney, Agent, or Firm* — Studebaker & Brackett PC; Tim L. Brackett, Jr.

(57) ABSTRACT

An inductance element is not interfered by peripheral circuits when mounted on a wiring board by forming a closed magnetic path. The inductance element has a small reduction of an inductance value when a direct current is superimposed, and thus has excellent direct current superimposition characteristics. The temperature coefficient of the magnetic permeability of a ferrite sintered body which constitutes a magnetic core can be positive. The temperature coefficient of the magnetic permeability of a soft magnetic resin provided as an external covering to cover a coil and to fill a space between flange sections of the magnetic core is permitted to be −30 ppm/° C. or less.

6 Claims, 2 Drawing Sheets

INDUCTANCE ELEMENT AND METHOD FOR MANUFACTURING THE SAME

CROSS REFERENCE TO RELATED APPLICATIONS

The present application is a continuation of International Application No. PCT/JP2008/067793, filed Oct. 1, 2008, which claims priority to Japanese Patent Application No. JP 2007-258317, filed Oct. 2, 2007, the entire contents of each of these applications being incorporated herein by reference in their entirety.

BACKGROUND

1. Field of the Invention

The invention relates to an inductance element and a method for manufacturing the inductance element, and more particularly, relates to an inductance element which has a closed magnetic path structure, and a method for manufacturing the inductance element having a closed magnetic path structure.

2. Description of the Related Art

Japanese Patent Application Laid-Open No. 2007-67081 (hereinafter, "Patent Document 1") discloses an inductance element including a magnetic core with a flange, which is formed of ferrite, a coil wound around the magnetic core, and a soft magnetic resin layer with magnetic powder therein, which is formed to cover the coil.

However, the inductance element described in Patent Document 1 forms a closed magnetic path, and thus, when a direct current is superimposed, there will cause magnetic saturation in which the magnetic flux density B shows almost no increase even when the magnetic field H, that is, the current through the coil is increased. As a result, the inductance element has a problem that the slope of the BH curve, that is, the magnetic permeability μ becomes smaller, thereby significantly reducing the inductance value.

Japanese Patent Application Laid-Open No. 6-251946 (hereinafter, "Patent Document 2") discloses an inductance part formed of a soft magnetic drum with a columnar section and enlarged flange sections on each end, a coil winding section wound around the columnar section, and a soft magnetic sleeve surrounding the soft magnetic drum and fitting the enlarged flange sections. The temperature coefficient of the soft magnetic drum and the temperature coefficient of the soft magnetic sleeve have opposite signs with respect to each other.

In the Patent Document 2 described above, permitting the respective temperature coefficients of the soft magnetic drum and soft magnetic sleeve to have opposite signs with respect to each other aims to cancel the two temperature coefficients each other to bring the temperature coefficient of the entire inductance part closer to substantially "0". However, Patent Document 2 completely fails to include any disclosure of direct current superimposition characteristics, and thus completely fails to disclose the combination of temperature coefficients required and the range of the temperature characteristics required to improve the current superimposition characteristics, as a matter of course.

SUMMARY

To overcome the problems described above, embodiments in accordance with the claimed invention provide an inductance element and a method for manufacturing the inductance element that include a closed magnetic path to reduce interference by peripheral circuits when mounted on a wiring board. The inductance element has a small reduction of an inductance value even when a direct current is superimposed, namely, excellent direct current superimposition characteristics.

In one aspect, an inductance element includes a magnetic core formed of a ferrite sintered body. The magnetic core includes a core section and flange sections provided on each end of the core section. A coil is wound on the core section, and an external covering is formed of a soft magnetic resin to cover the coil and fill a space between the flange sections. A temperature coefficient of a magnetic permeability of the ferrite sintered body is positive, and a temperature coefficient of a magnetic permeability of the soft magnetic resin is −30 ppm/° C. or less.

In another aspect, an embodiment of the soft magnetic resin can have a temperature coefficient of a magnetic permeability of −1000 ppm/° C. or less.

In another aspect, an embodiment of the ferrite sintered body can be a sintered body of a NiZnCu based ferrite material, and an embodiment of the soft magnetic resin can be a mixture of powder of a NiZnCu based ferrite material and a thermosetting resin.

In yet another aspect, an embodiment consistent with the claimed invention is directed to a method for manufacturing the inductance element described above.

In an embodiment, a method for manufacturing an inductance element includes preparing a magnetic core formed of a ferrite sintered body with a positive temperature coefficient of a magnetic permeability. The magnetic core includes a core section and flange sections provided on each end of the core section. The method includes winding a conductive wire on the core section, thereby forming a coil, mixing powder of a ferrite material and a thermosetting resin, thereby preparing a soft magnetic resin with a temperature coefficient of a magnetic permeability being −30 ppm/° C. or less, and providing the soft magnetic resin to cover the coil and to fill a space between the flange sections, thereby forming an external covering.

In yet another aspect, an embodiment of a process of preparing the soft magnetic resin can comprise preparing a soft magnetic resin with a temperature coefficient of a magnetic permeability being −1000 ppm/° C. or less.

In another aspect, when an inductance element is subjected to a superimposed direct current, the inductance element coil will produce heat that will be transferred by heat conduction to the magnetic coil and the external covering. As a result, the magnetic core and the external covering also will be heated. In this case, the magnetic permeability of the ferrite sintered body constituting the magnetic core is increased in accordance with the positive temperature coefficient, whereas the magnetic permeability of the soft magnetic resin constituting the external covering is decreased in accordance with the negative temperature coefficient, such as −30 ppm/° C. or less. Therefore, the magnetic path structure will be closer to an opened magnetic path, the concentration of the magnetic flux on the magnetic core will be relaxed, and the magnetic saturation of the magnetic core will be suppressed. As a result, the decrease in the inductance value of the inductance element will be reduced.

According to another aspect, a temperature coefficient of the magnetic permeability of the soft magnetic resin can be permitted to be −1000 ppm/° C. or less in some embodiments, which will significantly reduce the magnetic permeability of the soft magnetic material due to the heated external covering, as described above. Thus, a decrease in the inductance value due to direct current superimposition, in particular, in a high current region, can be more effectively suppressed.

In another aspect, the ferrite sintered body can be a sintered body of a NiZnCu based ferrite material, and the soft magnetic resin can be a mixture of powder of a NiZnCu based ferrite material and a thermosetting resin, to obtain an inductance element that can be used in a high frequency range.

In accordance with the method for manufacturing an inductance element according to the invention, an inductance element can be manufactured which has a magnetic shielding structure and excellent direct current superimposition characteristics.

In still another aspect, use of a soft magnetic resin with a temperature coefficient of a magnetic permeability of −1000 ppm/° C. or less in a method for manufacturing an inductance element according to exemplary embodiments can allow an inductance element to be manufactured showing effectively suppressed decrease in inductance value due to direct current superimposition, in particular, in a high current region.

DETAILED DESCRIPTION

Figure 1:
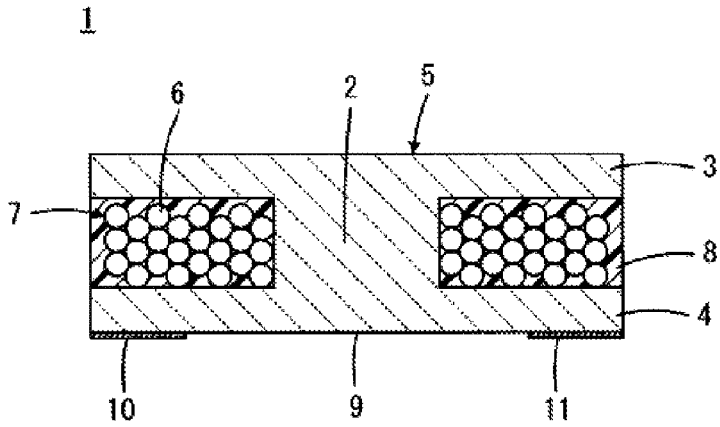
FIG. 1 is a cross-sectional view illustrating an inductance element 1 according to an exemplary embodiment.

FIG. 1 is a cross-sectional view illustrating an inductance element 1 according to an exemplary embodiment.

The inductance element 1 includes a magnetic core 5 formed of a ferrite sintered body, which has a core section 2 and flange sections 3 and 4 provided on each end of the core section 2. A coil 7 is provided on the core section 2 and can be formed by winding a conductive wire 6. An external covering 8 of a soft magnetic resin is provided to cover the coil 7 and to fill a space between the flange sections 3 and 4.

This inductance element 1 is treated as a surface-mountable chip part. Therefore, at least the lower principal surface 9 of the magnetic core 5 is made flat, and surface-mounted electrodes 10 and 11 are formed on this principal surface 9. The surface-mounted electrodes 10 and 11 are, not shown, electrically connected to each end of the coil 7 described above.

In this inductance element 1, a ferrite sintered body whose magnetic permeability has a positive temperature coefficient is used as the ferrite sintered body constituting the magnetic core 5. It is to be noted that the magnetic permeability for normal ferrite materials has a positive temperature coefficient. On the other hand, a soft magnetic resin whose magnetic permeability has a temperature coefficient of −30 ppm/° C. or less, and in some embodiments preferably −1000 ppm/° C. or less, can be used as the soft magnetic resin constituting the external covering 8.

Furthermore, it is preferable that the ferrite sintered body constituting the magnetic core 5 be a sintered body of a NiZnCu based ferrite material. On the other hand, it is preferable in some embodiments that the soft magnetic resin constituting the external covering 8 be a mixture of powder of a NiZnCu based ferrite material and a thermosetting resin such as a thermosetting epoxy resin.

Figure 3:
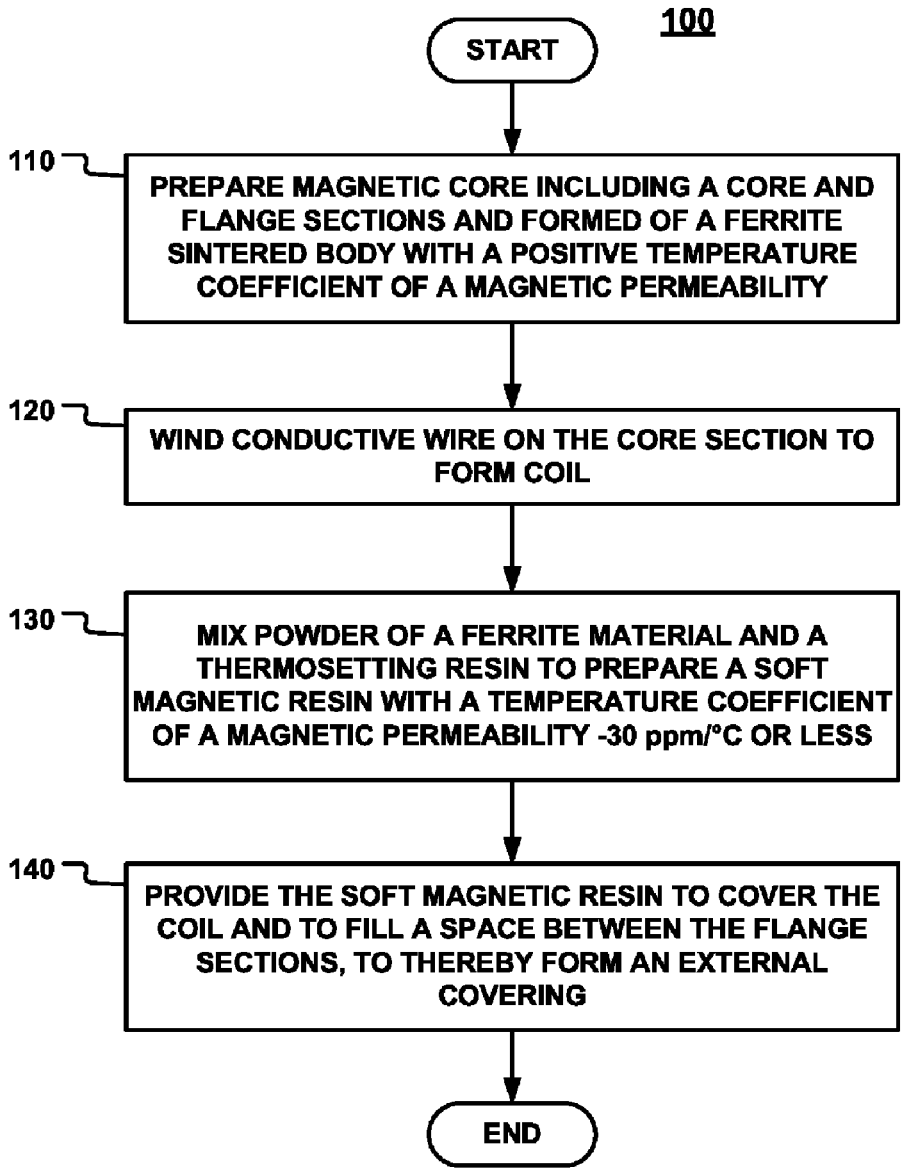
FIG. 3 is a diagram showing a process for manufacturing an inductance element according to an exemplary embodiment.

With reference to FIG. 3, a process 100 of manufacturing the inductance element 1 will now be described. Starting in process 110, the magnetic core 5 described above is prepared, and in process 120 the wire 6 is wound on the core section 2 of the magnetic core 5, thereby forming the coil 7. On the other hand, a soft magnetic resin is manufactured by mixing powder of a ferrite material and a thermosetting resin, as shown in process 130, and this soft magnetic resin is provided to cover the coil 7 and to fill the space between the flange sections 3 and 4 of the magnetic core 5, as shown in process 140, thereby forming the external covering 8.

In order to permit the temperature coefficient of the magnetic permeability of the soft magnetic resin manufactured as described above to be −30 ppm/° C. or less, or preferably −1000 ppm/° C. or less, the temperature coefficient of the magnetic permeability of the ferrite material mixed into the soft magnetic resin is adjusted.

Next, external examples will be described which were carried out for confirming advantageous effects of the invention.

Calcined powder of a NiZnCu based ferrite material adjusted to have a predetermined composition and a polyvinyl alcohol as a binder were added to deionized water, and mixed and ground in a ball mill in a wet manner to obtain a slurry containing the ferrite material. This slurry was removed from the ball mill, and granulated and dried using a spray dryer to obtain granulated ferrite powder with a grain size ($D_{50}$) of 100 μm at a cumulative frequency of 50%.

Next, the granulated ferrite powder was subjected to press forming to obtain compacts to serve as magnetic cores in a shape with a core section and flange sections on each side of the core section. Then, the compacts were arranged in a zirconia box, subjected to a binder removal treatment in a batch furnace, and then calcined at a temperature of 900 to 1000° C. for 2 hours to obtain magnetic cores formed of ferrite sintered bodies. The ferrite sintered body constituting the magnetic core had a temperature coefficient of a magnetic permeability of +3000 ppm/° C. (a temperature coefficient at 150° C., with 20° C. as a reference), and had outside dimensions of 3.0 mm×3.0 mm×1.0 mm.

Next, a copper wire 80 μm in wire diameter with an insulating film was wound on the core section of this magnetic core to form a coil. Then, each end of the copper wire constituting this coil was solder-mounted to each of a pair of surface-mounted electrode formed on the lower principal surface of the magnetic core.

On the other hand, powder (calcined and ground) of a NiZnCu based ferrite material was prepared, added to a thermosetting epoxy resin at a ratio of 50% by volume, and mixed to manufacture a soft magnetic resin. Then, as the soft magnetic resin, a soft magnetic resin with the temperature coefficient of the magnetic permeability being −1800 ppm/° C. in the case of curing at a temperature of 200 to 300° C. (Example 1), a soft magnetic resin with the temperature coefficient being −1000 ppm/° C. (Example 2), a soft magnetic resin with the temperature coefficient being −30 ppm/° C. (Example 3), and a soft magnetic resin with the temperature coefficient being +120 ppm/° C. (Comparative Example) were manufactured respectively by changing the composition of the powder of the added NiZnCu based ferrite material and the calcination temperature. It is to be noted that the magnetic permeability of the soft magnetic resin at 20° C. was 5 for any of Examples 1 to 3 and the Comparative Example.

Next, the soft magnetic resin according to each of Examples 1 to 3 and the Comparative Example described above was provided to cover the coil described above and to fill a space between the flange sections of the magnetic core, and cured at a temperature of 200 to 300° C. to obtain inductance elements according to the respective samples.

Figure 2:
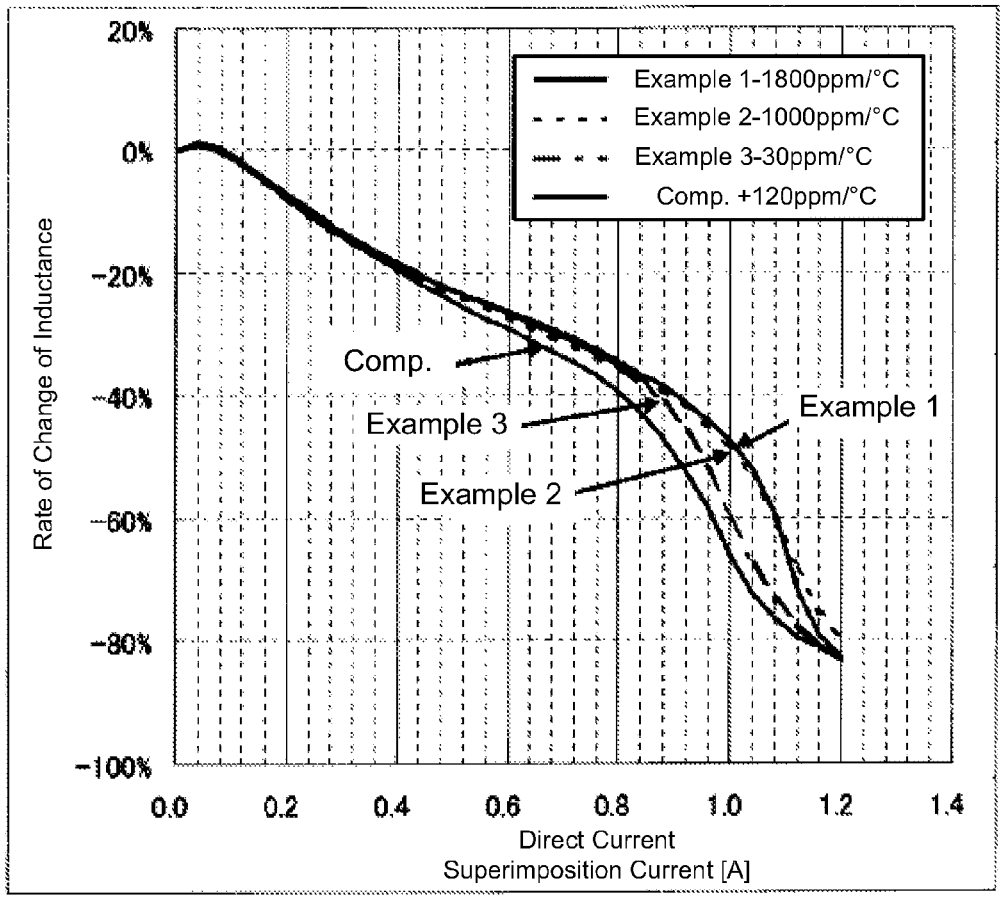
FIG. 2 is a diagram showing direct current superimposition characteristics of inductance elements according to each of Examples 1 to 3 and Comparative Example manufactured in experimental examples carried out for confirming the advantageous effects of the invention.

A direct current was applied in the range of 0 to 1.2 A to the coils of the inductance elements according to the thus obtained respective samples to measure the inductance values of the inductance elements, and from the values, the rates of change of the inductance values were obtained. The results are shown in FIG. 2. In FIG. 2, the vertical axis indicates a rate of change of an inductance value (rate of change of inductance), and the horizontal axis indicates a direct current superimposition current. The Comparative Example is indicated as "Comp." in FIG. 2.

It is determined that Examples 1 to 3 in which the magnetic permeability of the soft magnetic resin constituting the external covering has a temperature coefficient of −30 ppm/° C. or less, show that the current value at which the rate of change of inductance is −30 to −60% is improved by 5% or more, as compared with the Comparative Example in which the magnetic permeability has a temperature coefficient more than −30 ppm/° C., and thus have excellent direct current superimposition characteristics. In particular, Examples 1 and 2 in which the magnetic permeability of the soft magnetic resin has a temperature coefficient of −1000 ppm/° C. or less, show that the current value at which the rate of change of inductance is −30 to −60% is improved by 10% or more, and thus have direct current superimposition characteristics more significantly improved.

Although a limited number of embodiments are described herein, one of ordinary skill in the art will readily recognize that there could be variations to any of these embodiments and those variations would be within the scope of the appended claims. Thus, it will be apparent to those skilled in the art that various changes and modifications can be made to the inductance element and method for manufacturing an inductance element described herein without departing from the scope of the appended claims and their equivalents.

The invention claimed is:

1. An inductance element comprising:

a magnetic core formed of a ferrite sintered body, the magnetic core including a core section and flange sections provided on each end of the core section;

a coil wound on the core section; and an external covering formed of a soft magnetic resin, the external covering formed to cover the coil and to fill a space between the flange sections;

wherein a temperature coefficient of a magnetic permeability of the ferrite sintered body is positive, and a temperature coefficient of a magnetic permeability of the soft magnetic resin is −30 ppm/° C. or less.

2. The inductance element according to claim 1, wherein the soft magnetic resin has a temperature coefficient of a magnetic permeability of −1000 ppm/° C. or less.

3. The inductance element according to claim 2, wherein the ferrite sintered body is a sintered body of a NiZnCu based ferrite material, and the soft magnetic resin is a mixture of powder of a NiZnCu based ferrite material and a thermosetting resin.

4. The inductance element according to claim 1, wherein the ferrite sintered body is a sintered body of a NiZnCu based ferrite material, and the soft magnetic resin is a mixture of powder of a NiZnCu based ferrite material and a thermosetting resin.

5. A method for manufacturing an inductance element, comprising:

preparing a magnetic core formed of a ferrite sintered body with a positive temperature coefficient of a magnetic permeability, the magnetic core including a core section and flange sections provided on each end of the core section;

winding a conductive wire on the core section, thereby forming a coil;

mixing powder of a ferrite material and a thermosetting resin, thereby preparing a soft magnetic resin with a temperature coefficient of a magnetic permeability being −30 ppm/° C. or less; and providing the soft magnetic resin to cover the coil and to fill a space between the flange sections, thereby forming an external covering.

6. The method for manufacturing an inductance element according to claim 5, wherein preparing the soft magnetic resin comprises preparing a soft magnetic resin with a temperature coefficient of a magnetic permeability being −1000 ppm/° C. or less.

* * * * *